US007194988B2

(12) United States Patent
Ohmori et al.

(10) Patent No.: US 7,194,988 B2
(45) Date of Patent: Mar. 27, 2007

(54) COMBUSTION-TYPE POWER TOOL

(75) Inventors: Yasuki Ohmori, Hitachinaka (JP); Shinki Ohtsu, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/274,323

(22) Filed: Nov. 16, 2005

(65) Prior Publication Data

US 2006/0102111 A1 May 18, 2006

(30) Foreign Application Priority Data

Nov. 16, 2004 (JP) ..... P2004-332078

(51) Int. Cl.
*B25C 1/08* (2006.01)

(52) U.S. Cl. ..... 123/48 R; 123/46 H

(58) Field of Classification Search ..... 123/48 R, 123/46 H, 46 R

See application file for complete search history.

(56) References Cited

U.S. PATENT DOCUMENTS

| | | | | |
|---|---|---|---|---|
| 4,403,722 | A | 9/1983 | Nikolich | |
| 4,483,280 | A | 11/1984 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 6,968,811 | B2 * | 11/2005 | Rosenbaum | 123/41.2 |
| 2006/0225675 | A1 * | 10/2006 | Nishikawa et al. | 123/46 H |

FOREIGN PATENT DOCUMENTS

| | | |
|---|---|---|
| EP | 1 459 850 | 11/1984 |
| JP | 64-9149 | 2/1989 |
| JP | 1-34753 | 7/1989 |
| JP | 3-25307 | 4/1991 |
| JP | 4-11337 | 2/1992 |
| JP | 4-48589 | 8/1992 |
| JP | 2004-314263 | 11/2004 |

* cited by examiner

*Primary Examiner*—Stephen K. Cronin
*Assistant Examiner*—Jason Benton
(74) *Attorney, Agent, or Firm*—Antonelli, Terry, Stout and Kraus, LLP.

(57) ABSTRACT

A combustion-type power tool includes a cylinder and a combustion chamber disposed on top of the cylinder that accommodates a gaseous mixture of existing air in the combustion chamber and fuel injected therein. A spark plug generates a spark to combust the gaseous mixture in the combustion chamber. A trigger switch produces the spark in the spark plug when operated. A piston is movably supported in the cylinder and driven by combustion in the combustion chamber. A driving blade is integrally formed with the piston for driving a fastener. A push lever is provided at one end of the housing and coupled with the combustion chamber frame. A temperature sensor is provided, for example, on the combustion chamber frame to sense the temperature thereof. A stopper is operated to adjust the position of the push lever to be shifted from an initial position when the sensed temperature is higher than a critical value. The push lever is positioned farther from another end of the housing when adjusted than when the push lever is in the initial position.

8 Claims, 3 Drawing Sheets

COMBUSTION-TYPE POWER TOOL

BACKGROUND OF THE INVENTION

1. Field of the Invention

The present invention relates to a combustion-type power tool, such as combustion-powered fastener-driving tool for driving fasteners, such as nails, into a workpiece.

2. Description of the Related Art

Combustion-type power tools have been known in the art as disclosed in Japanese Patent Publication (B2) Nos. HEI-1-34753, HEI-4-48589, HEI-3-25307, HEI-4-11337, and SHO-64-9149.

Unlike a compressed-air type power tool that uses compressed air as a driving source, the combustion-type power tool requires no compressor and is, therefore, much easier to transport to a construction site or the like. Further, the combustion-type power tool can be conveniently provided with an internal power source, such as a battery, so that the tool can be used in any environment without requiring a commercial power supply.

Generally, the combustion-type power tool is made up of metal components, such as a cylinder, rubber components, such as shielding member, and plastic components, such as a housing. When fastener driving operations are successively performed with a short interval, heat generated by combustion is partly dissipated when a fan performs scavenging such that the exhaust gas in the combustion chamber can be scavenged therefrom, and is partly absorbed by the metal components, particularly by the cylinder and a combustion chamber frame. The temperature of these metal components gradually increases and finally they become overheated. When the cylinder and the combustion chamber frame become high temperature, the gas remaining in the combustion chamber is not sufficiently cooled down so that thermal vacuum in the combustion chamber cannot be attained. Hence, delay occurs in returning the piston to the original position after the fastener driving operation is performed. Due to this delay, a cycle speed for completing one-shot fastener driving operation is lowered and so the work efficiency is degraded.

If the fastener driving operation is continued, the housing and the handle disposed near the combustion chamber frame and the cylinder are also heated up. The operator grasping the handle may not be able to continue the fastener driving operation. If so, the work efficiency is further degraded.

The sealing member, which is made from rubber and used for sealing the combustion chamber, may thermally be damaged and sealing capability with the sealing member may not be maintained. If it is the case, the combustion chamber is communicated with external atmosphere and the flammable gas introduced into the combustion chamber will not be ignited. Then, the fastener driving operation can no longer be continued even if the trigger switch is turned on. The housing, which is made from plastic, may also be damaged or distorted by the heat. If the sealing member and/or the housing is damaged, the tool needs to be disintegrated and a damaged component has to be replaced with a new one.

SUMMARY OF THE INVENTION

In view of the foregoing, it is an object of the present invention to prevent thermal damage of a sealing member and/or a housing of a combustion-type power tool, thereby prolonging the service life of the tool.

It is another object of the present invention to provide a combustion-type power tool wherein work efficiency is improved without degrading operability of the tool.

In order to attain the above and other objects, a combustion-type power tool according to the present invention includes a housing, a head, a handle, a cylinder, a piston, combustion chamber frame, a push lever, a spark plug, a trigger switch, a driving blade, a temperature sensor, and a stopper. The housing has first and second end portions. The head is provided at the first end portion of the housing. The handle extends from the housing. The cylinder is fixedly disposed within the housing. The piston is movably supported in the cylinder. The combustion chamber frame is disposed within the housing to be movable along the cylinder. A combustion chamber is formed by the head, the cylinder, the piston, and the combustion chamber frame when the combustion chamber frame is in abutment with the head. The combustion chamber accommodates a gaseous mixture of existing air in the combustion chamber and fuel injected therein. The push lever is mounted on the second end portion of the housing and coupled with the combustion chamber frame. The push lever is movable into the housing, causing the combustion chamber frame to move together with the push lever, when the push lever is pushed against a workpiece. The spark plug is disposed in the combustion chamber and generates a spark to combust the gaseous mixture in the combustion chamber. The piston is driven by combustion in the combustion chamber. The trigger switch is provided to the handle and produces the spark in the spark plug when operated. The driving blade is integrally formed with the piston for driving a fastener. The temperature sensor is provided for sensing a temperature of at least one selected portion within the housing or on the handle. The stopper is operable to adjust a position of the push lever to be shifted from a first position to a second position when the temperature sensed by the temperature sensor is higher than a critical value.

The push lever is positioned farther from the head when the push lever is in the second position than when the push lever is in the first position.

The stopper is selectively movable between the first and second positions.

It is preferable to dispose the temperature sensor on the combustion chamber frame.

It is also preferable to operate the stopper by an electromagnetic solenoid.

The temperature sensor may be one of a thermistor, a thermocouple, and a bimetal.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

A combustion-powered fastener-driving tool according to a preferred embodiment of the invention will be described with reference to the accompanying drawings.

The following is a general description of a representative combustion-powered fastener-driving tool to which the present invention is applied. The combustion-powered fastener-driving tool drives fasteners, such as nails, rivets, staples, or the like. In the following description, nails will be taken as an example of the fasteners. Hereinafter, the terms "upward", "downward", "upper", "lower", "above", "below", "beneath" and the like will be used throughout the description assuming that the combustion-powered fastener-driving tool is disposed in an orientation in which it is used as shown in FIGS. 1 and 2.

Figure 1:
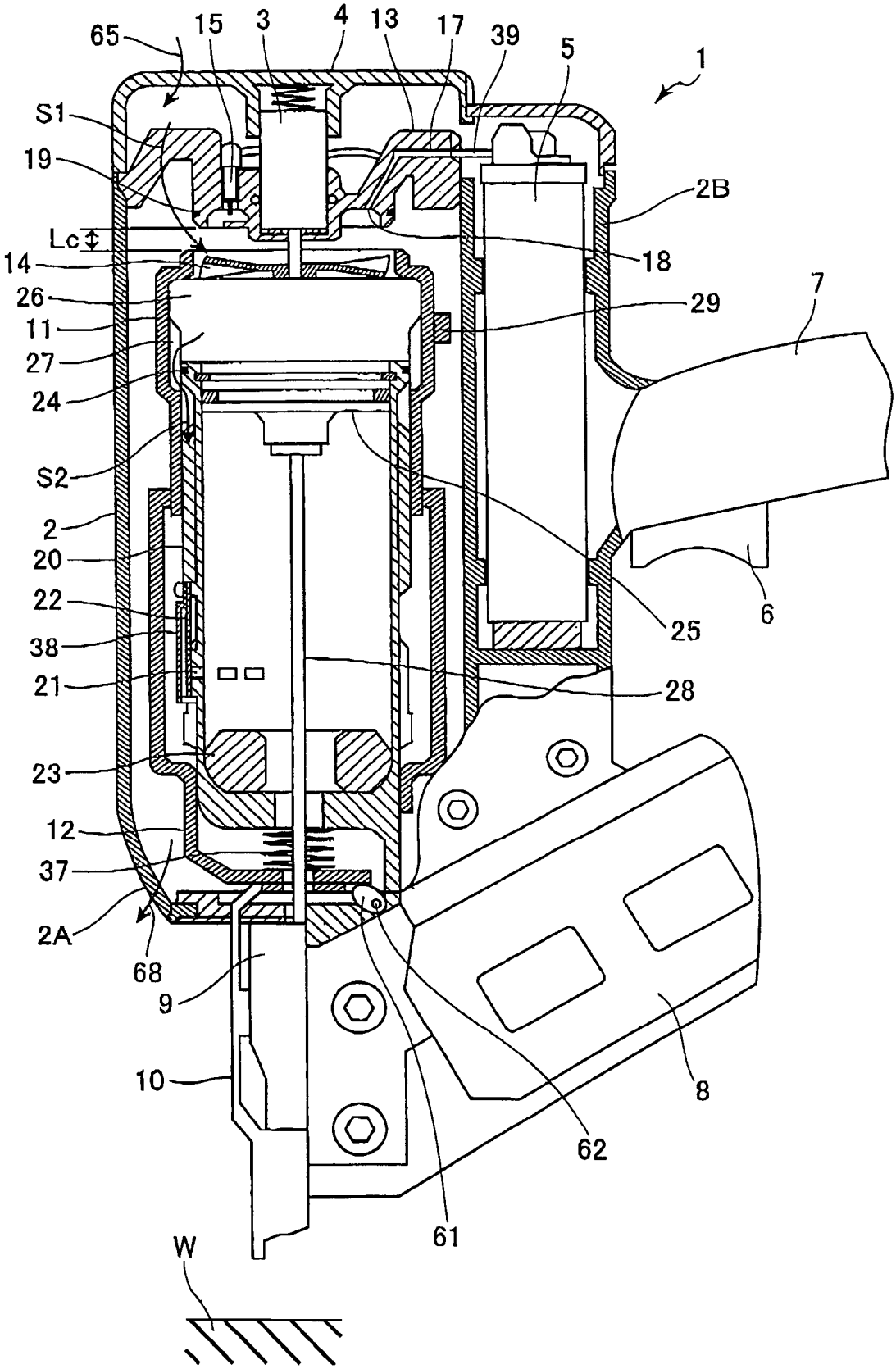
FIG. 1 is a vertical cross-sectional view showing a low-temperature condition of a combustion-powered fastener-driving tool according to an embodiment of the present invention.
Figure 2:
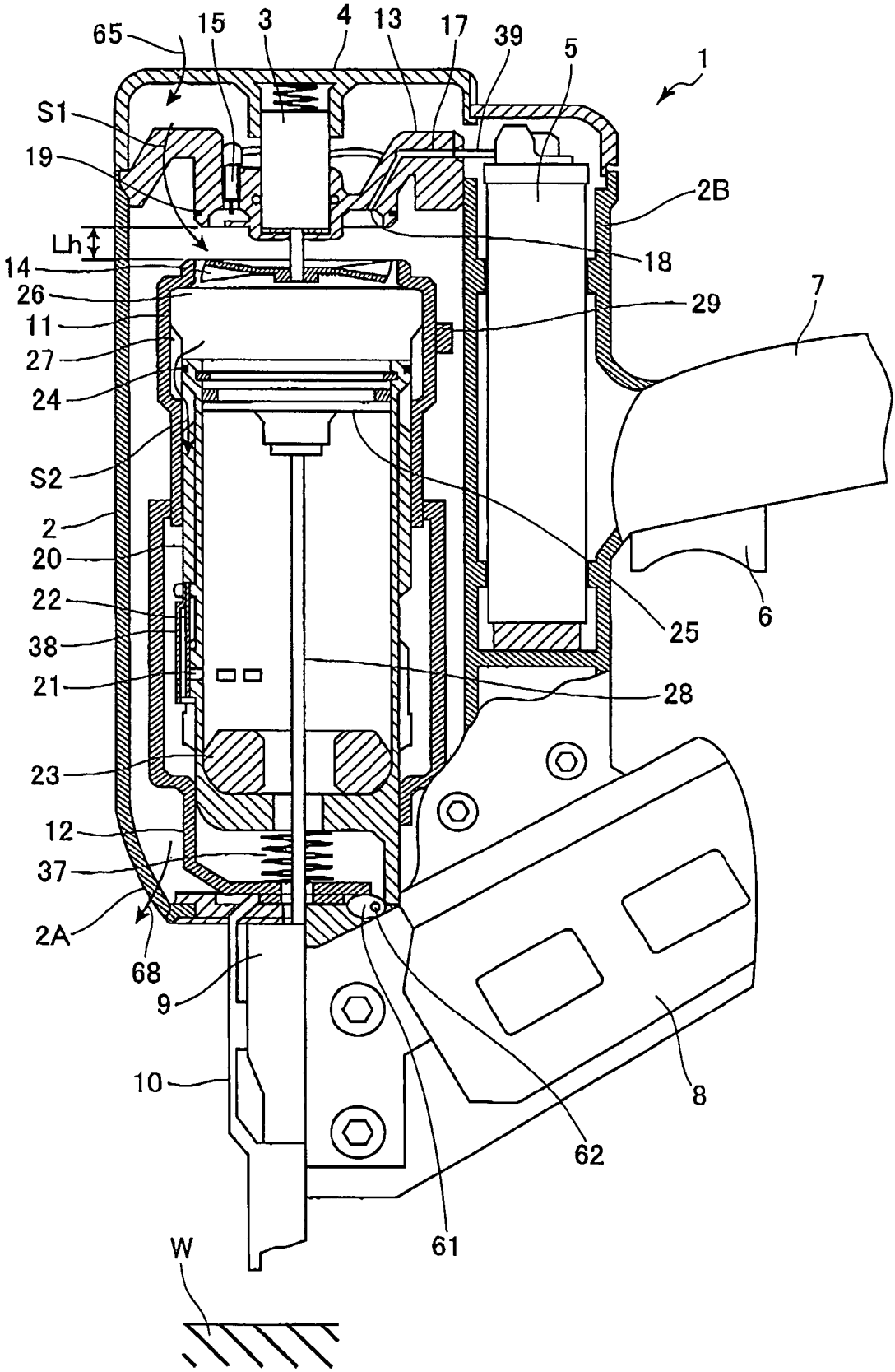
FIG. 2 is a vertical cross-sectional view showing a high-temperature condition of the combustion-powered fastener-driving tool according to the embodiment of the present invention.

FIGS. 1 and 2 are vertical cross-sectional views showing a combustion-powered fastener-driving tool 1, and particularly a nail-driving tool. The components and operations of the nail-driving tool are described below with reference to FIGS. 1 and 2.

As shown in FIG. 1, the fastener-driving tool 1 includes a housing with an elongated shape. The housing includes a main housing 2A and a sub housing 2B, in which the sub housing 2B is coupled to the main housing 2A along the longitudinal direction of the main housing 2A. The main housing 2A and the sub housing 2B are integrally coupled together to form a framework of the fastener-driving tool 1.

A head cover 4 is attached to the upper end of the main housing 2A. An intake port (not shown) is formed in the head cover 4 and an exhaust port (not shown) is formed in the lower portion of the main housing 2A. A gas cylinder 5, which stores flammable gas (liquid gas), is detachably accommodated in the sub housing 2B. A handle 7 provided with a trigger switch 6 is secured to the sub housing 2B. A magazine 8 and a tail cover 9 are mounted below the main housing 2A and the sub housing 2B. The magazine 8 is filled with a plurality of the nails. The tail cover 9 guides the nails supplied from the magazine 8 and sequentially sets the nails in a predetermined position beneath a piston 25.

The main housing 2A houses therein a push lever 10, a connection member 12, a cylinder 20, the piston 25, a driving blade 28 extending from the piston 25, a fan 14, a motor 3, a spark plug 15, a combustion chamber frame 11, and a head cap 13. The push lever 10 projects downward from the lowermost portion of the main housing 2A to be vertically movably supported thereon. The push lever 10 is coupled with the connection member 12 fixed to the combustion chamber frame 11. A spring 37 urges the combustion chamber frame 11 downward in the drawing, that is, in a direction for driving the nail. Hence, the combustion chamber frame 11 is capable of moving axially with respect to the main housing 2A.

When the push lever 10 is pressed against a workpiece W, such as a wood material, the push lever 10 opposes the urging force of the spring 37. The upper portion of the push lever 10 retracts into the main housing 2A and the combustion chamber frame 11 moves above the cylinder 20, forming a combustion chamber 26. Specifically, the combustion chamber 26 is a space enclosed by the combustion chamber frame 11, the head cap 13, and the piston 25, in which a mixture of a flammable gas and air is burned. In order to form a hermetically sealed combustion chamber 26, a first seal member 19, such as an O-ring, is provided on the lower end of the head cap 13. Also, a second seal member 24, such as an O-ring, is provided on the upper portion of the cylinder 20 to seal the space between the lower inner periphery of the combustion chamber frame 11 and the upper outer periphery of the cylinder. This space is created when the combustion chamber frame 11 is brought into abutment with the head cap 13.

The head cap 13 is fixed to the top end of the main housing 2A. The combustion chamber 26 accommodates the tan 14, which can be rotated by the motor 3 fixedly mounted on the head cap 13, and the spark plug 15 for generating a spark when the trigger switch 6 is operated.

The main housing 2A further accommodates a head switch 16 (see FIG. 3) and a temperature sensor 29, The head switch 16 is provided for detecting an uppermost stroke end position of the combustion chamber frame 11 when the fastener driving tool 1 is pressed against the workpiece W. The head switch 16 is turned on when the push lever 10 is elevated to a predetermined position so that rotation of the motor 3 and the fan 14 is started. The temperature sensor 29, such as a thermistor, thermocouple, or bimetal, is affixed to the outer wall of the combustion chamber frame 11 for sensing the temperature of the combustion chamber frame 11. The temperature sensor 29 may be disposed on the outer wall of the handle 7 or any other places where the temperature tends to rise as the nail driving operations are repeatedly performed.

The head cap 13 has a handle side in which is formed a fuel injection passage 17 which allows the flammable gas to pass therethrough. One end of the fuel injection passage 17 serves as an injection port 18 that opens at the lower surface of the head cap 13. Another end of the fuel injection passage 17 is engaged with the gas cylinder-connecting portion in communication with the gas cylinder 5. The injection port 18 injects flammable gas into the combustion chamber 26 from the gas cylinder 5, which stores this flammable gas (liquid gas).

Provided below the cylinder 20 are an exhaust hole 21, a check valve 22 for opening and closing the exhaust hole 21, and the bumper 23 against which the piston 25 collides. The exhaust hole 21 is in communication with the exhaust port formed in the lower portion of the main housing 2A. An exhaust-hole cover 38 provided to cover the exhaust hole 21 serves to change the flow direction of the exhaust gas. Specifically, with the exhaust-hole cover 38, the exhaust gas out from the exhaust hole 21 is guided to flow in the axial direction of the cylinder 20. When the piston 25 abruptly moves to its bottom dead center to drive the nail and collides with the bumper 23, the bumper 2 deforms to absorb excess energy in the piston 25.

The piston 25 is slidably and reciprocally provided in the cylinder 20. The piston 25 divides an inner space of the cylinder 20 into an upper space above the piston 25 and a lower space below the piston 25. The driver blade 28 extends downwards from a side of the piston 25, the side being at the cylinder space below the piston 25, to the tail cover 9. The driver blade 28 is positioned coaxially with the nail setting position in the tail cover 9, so that the driver blade 28 can strike against the nail during movement of the piston 25 toward its bottom dead center. When the piston 25 moves to its bottom dead center, the piston 25 collides against the bumper 24 and is stopped thereby. In this case, the bumper 24 absorbs a surplus energy of the piston 25.

When the upper end of the combustion chamber frame 11 abuts the head cap 13, the head cap 13, the combustion chamber frame 11, and the upper cylinder space above the piston 25 define a combustion chamber 26. When the combustion chamber frame 11 is separated from the head cap 13, a first flow passage S1 in communication with an atmosphere is provided between the head cap 13 and the upper end portion of the combustion chamber frame 11, and a second flow passage S2 in communication with the first flow passage S1 is provided between the lower end portion of the combustion chamber frame 11 and the upper end portion of the cylinder 20. These flow passages S1, S2 allow a combustion gas and a fresh air to pass along the outer peripheral surface of the cylinder 20 for discharging the mixture of the combustion gas and air through the exhaust port of the housing 2. Further, the above-described intake port is formed for supplying a fresh air into the combustion chamber 26, and the exhaust hole 21 is formed for discharging exhaust gas generated in the combustion chamber 26. Fins 27 are also provided around the inner periphery of the combustion chamber 26 as ribs that protrude radially inward.

The fan 14 and the spark plug 15 are disposed within the combustion-chamber 26, and the injection port 18 is open to the combustion chamber 26. Rotation of the fan 14 performs the following three functions. First, the fan 14 stirs and mixes the air with the flammable gas as long as the combustion chamber frame 11 remains in abutment with the cylinder head 11. Second, after the mixed gas has been ignited, the fan 14 causes turbulent combustion of the air-fuel mixture, thus promoting the combustion of the air-fuel mixture in the combustion chamber 26. Third, the fan 14 performs scavenging such that the exhaust gas in the combustion chamber 26 can be scavenged therefrom and also performs cooling to the combustion chamber frame 11 and the cylinder 20 when the combustion chamber frame 11 moves away from the cylinder head 11 and when the first and second flow passages S1, S2 are provided.

An ellipse-shaped stopper 61 is pivotally movably supported on a shaft 62 upstanding on the lower end side face of the connection member 12 to which coupled are the push lever 10 and the combustion chamber frame 11. The connection member 12, which is urged downwardly by means of the compression coil spring 37, is normally in abutment with the stopper 61, thereby placing the connection member 12 at its lowermost position. That is, the stopper 61 serves to position the push lever 10 and the combustion chamber frame 11.

In a state when the tool 1 is not pressed against the workpiece W, the stopper 61 is held in a position so that the first flow passage S1 has a channel height Lc. The stopper 61 is connected to both a temperature sensor 29 and a temperature switch control circuit 45 (see FIG. 3) and is pivotally moved by, for example, an electromagnetic solenoid (not shown).

When the temperature of the combustion chamber frame 11 is below a critical value, the channel height of the first flow passage S1 is held Lc whereas when the temperature of the combustion chamber frame 11 is higher than the critical value, the channel height of the first flow passage S1 is held Lh (see FIG. 2) greater than Lc. Above the critical temperature value, the rubber seal members 19 and 24 may be thermally deformed or damaged and thermal vacuum with a sufficient level may not be created.

Figure 3:
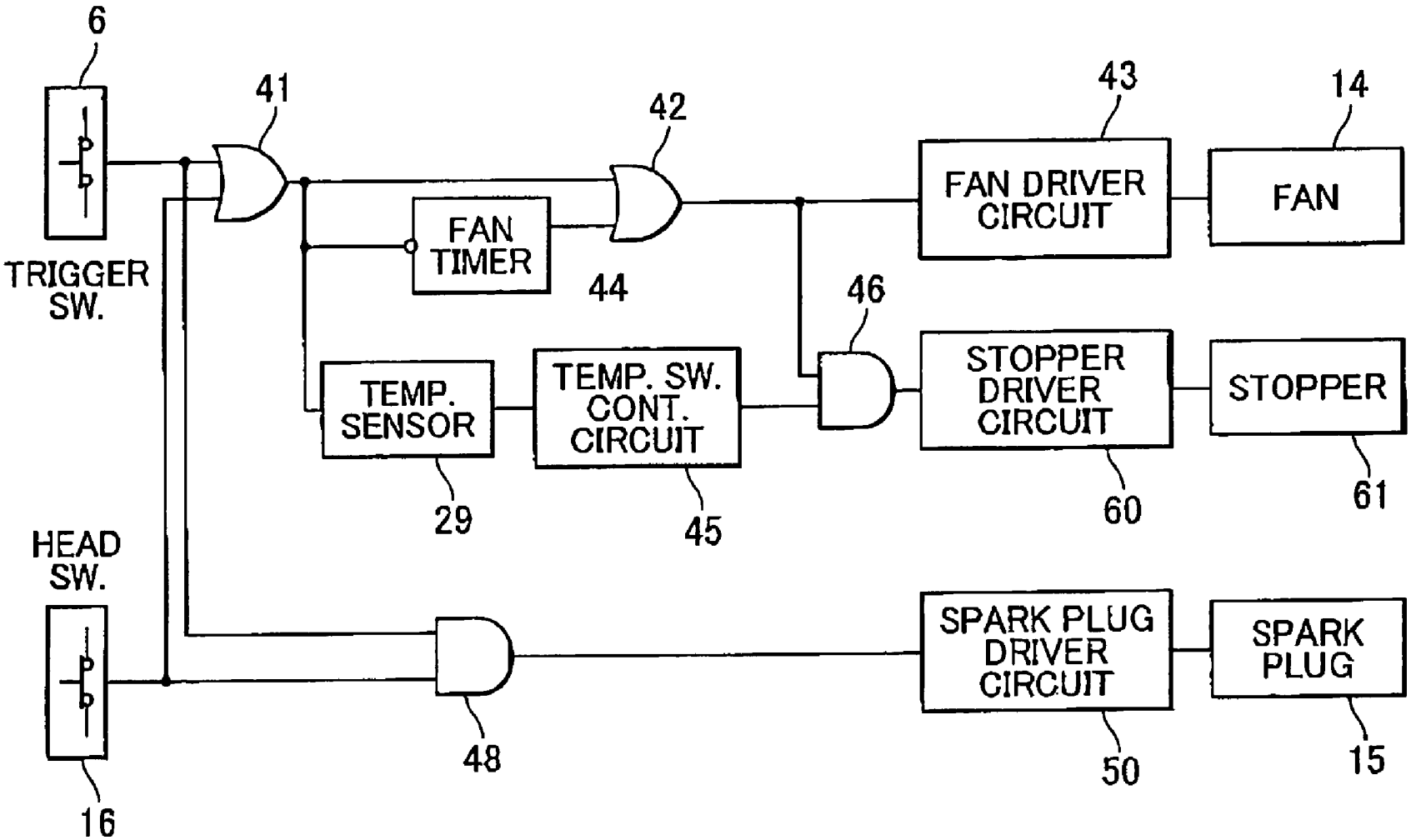
FIG. 3 is a block circuit diagram for operating a fan, stopper, and an ignition plug of the combustion-powered fastener-driving tool according to the embodiment of the present invention.

FIG. 3 is a block circuit diagram for controlling the fan 14, the stopper 61, and the spark plug 15. The trigger switch 6 and the head switch 16 are connected to the input terminals of a first OR circuit 41. The first OR circuit 41 has an output terminal connected to a first input terminal of a second OR circuit 42. The second OR circuit 42 has an output terminal connected to a fan driver circuit 43 for rotating the fan 14 with the motor 3. Accordingly, when at least one of the trigger switch 6 and the head switch 16 is turned on, the fan driver circuit 43 is energized to start rotating the motor 3 and the fan 14 connected thereto.

A fan timer 44 is connected between the output terminal of the first OR circuit 41 and a second input terminal of the second OR circuit 42. The fan timer 44 is activated when both the trigger switch 6 and the head switch 16 are turned off. The fan timer 44 stops rotations of the fan 14 after elapse of a predetermined period of time from activation of the fan timer 44.

The temperature sensor 29 is also connected to the output terminal of the first OR circuit 41. Accordingly, the temperature sensor 29 performs the temperature sensing operation when at least one of the trigger switch 6 and the head switch 16 is turned on. The temperature switch control circuit 45 is connected to the temperature sensor 29 to receive a temperature signal from the temperature sensor 29. The output of the temperature switch control circuit 45 is connected to one input terminal of an AND circuit 46. Another input terminal of the AND circuit 46 is connected to the output terminal of the second OR circuit 42, When the temperature sensed by the temperature sensor 29 is lower than the critical value, the stopper driver circuit 60 is not operated so that the stopper 61 is held in a predetermined UP position. Therefore, the combustion chamber frame 11, which is coupled to the push lever 10 through the connection member 12, is held in a normal position where the channel height of the first flow passage S1 is held Lc. On the other hand, when the temperature sensed by the temperature sensor 29 exceeds the critical value, the temperature switch control circuit 45 outputs a signal to the AND gate so as to enable the same. As a result, the stopper driver circuit 60 drives the stopper 61 to move to a predetermined DOWN position. The movement of the stopper 61 to the predetermined DOWN position causes the position of the combustion chamber frame 11 to a position lower than the normal position. Accordingly, the channel height of the first flow passage S1 is held Lh as shown in FIG. 2.

A second AND circuit 48 has two input terminals connected to the trigger switch 6 and the head switch 16. The output of the second AND circuit 48 is connected to a spark plug driver circuit 50 and the driver circuit 50 is in turn connected to the spark plug 16. Accordingly, when both the trigger switch 6 and the head switch 16 are turned on, an ON signal is output to the spark plug driver circuit 50, thereby igniting the spark plug 16.

Next, operation of the above-described fastener driving tool 1 will be described.

In a static state where the tool 1 is not driven, the stopper 61 is held in the predetermined UP position as shown in FIG. 1. In this state, the push lever 10 is urged by the spring 37 to protrude lower than the bottom end of the tail cover 9. The connection member 12 is in abutment with the stopper 61, and hence the combustion chamber frame 11 coupled to the connection member 12 is in the predetermined upper position. At this time, a gap is formed between the top end of the combustion chamber frame 11 and the bottom of the head cap 13, and another gap is formed between the combustion chamber frame 11 and the top end of the cylinder 20. Thus, the first and second flow passages S1 and S2 are formed. The channel height of the first flow passage S1 is set to be Lc as shown in FIG. 1. At this time, the piston 25 is held in its upper dead center in the cylinder 20.

If a user grips the handle 7 and pushes the end of the push lever 10 against the workpiece W when the fastener-driving tool 1 is in this state, the push lever 10 moves upward against the opposing force of the spring 37, causing the combustion chamber frame 11, which is coupled to the push lever 10, to rise to the position shown in FIG. 2. Raising the combustion chamber frame 11 to this position closes the first and second flow passages Si and S2 and forms the combustion chamber 26, which is hermetically sealed by the seal members 19 and 24 and thus closed off from the external air.

The gas cylinder 5 (fuel cell) is moved toward the head cap 13 by means of a cam (not shown) in accordance with the operation of the push lever 10. Then, an injection rod 39 of the gas cylinder 5 is pressed against the gas cylinder connection portion formed in the head cap 13, causing flammable gas to be injected through the injection port 18 into the combustion chamber 26.

Further, when the combustion chamber frame 11 is further raised to its upper dead center in association with the upward movement of the push lever 10, the head switch 16 is turned on. The driver circuit 43 of the motor 3 is then energized and the motor 3 drives the fan 14 to rotate. At the same time, the temperature sensor 29 is turned on and performs a temperature sensing operation. The flammable gas injected into the combustion chamber 26 is agitated and mixed with air in the combustion chamber 26 by the fan 14 rotating within the hermetically sealed combustion chamber 26 in cooperation with the fins 27 protruding inside the combustion chamber 26. Here, the flammable gas stored in the gas cylinder 5 is a pressurized, liquid gas that becomes gasified when injected into the combustion chamber 26. A measuring valve (not shown) is provided on the top end of the gas cylinder 5 for adjusting the amount of gas injected from the gas cylinder 5 through the injection port 18.

After pressing the push lever 10 against the workpiece W, if the user pulls the trigger switch 6 provided on the handle 7 regardless of the temperature sensed by the temperature sensor 29, then the spark plug 15 produces a spark for igniting and burning the gaseous mixture. The combusted gas expands to move the piston 25 downward and strike the nail in the tail cover 9.

After striking the nail, the piston 25 contacts the bumper 23, and the combusted gas is discharged from the cylinder 20 via the exhaust hole 21. As described above, the check valve 22 is disposed in the exhaust hole 21. This check valve is closed after the combusted gas has been discharged from the cylinder 20 and at the point that the interior of the cylinder 20 and the combustion chamber 26 have reached atmospheric pressure. While the gas remaining in the cylinder 20 and the combustion chamber frame 11 has just been combusted and is high in temperature, the heat from the combusted gas is absorbed by the inner walls of the cylinder 20 and combustion chamber frame 11 and by the fins 27 and the like, thereby rapidly cooling the gas. As a result, the pressure in the combustion chamber 26 drops to atmospheric pressure or below (thermal vacuum) and the piston 25 is drawn back to its initial upper dead center.

In this embodiment, in order to positively produce and maintain the thermal vacuum in the combustion chamber 26, the combustion chamber frame 11 does not move downward immediately after the combustion. That is, the combustion chamber frame 11 is held in the upper dead center even if the lower end of the push lever 10 is separated from the workpiece W caused by the reaction force resulting from the nail striking operation, so that the first and second flow passages S1 and S2 are not created immediately after the combustion. To this end, the combustion chamber 26 is prohibited from being opened to atmosphere as far as the trigger switch 6 is held in on state.

When the user subsequently lifts the tool 1 so as to be separated from the workpiece W and then releases the trigger switch 6 (turns the trigger switch 6 off), the push lever 10 separates from the workpiece W, allowing the push lever 10 and the combustion chamber frame 11 to move downward by the urging force of the spring 37 and return to the position shown in FIG. 1. The downward movement of the combustion chamber frame 11 creates the first and second flow passages S1 and S2. At this time, the fan 14 continues rotating for a prescribed time.

In the state shown in FIG. 1, the first and second flow passages S1 and S2 exist above and below the combustion chamber frame 11 so that the combustion chamber 26 is not hermetically sealed. In this state, the rotating fan 14 draws fresh air through an inlet formed in the top surface of the main housing 2A and exhausts residual gas out through the discharge port formed in the bottom of the main housing 2A, as indicated by arrows 65 through 68, thereby scavenging the air in the combustion chamber 26. Then, the fastener-driving tool 1 is returned to its initial state shown in FIG. 1.

In accordance with the turn-off operation of the trigger switch 6 and the downward movement of the combustion chamber frame 11, the head switch 16 is turned off. Then, the fan timer 44 is activated, and after a prescribed time from the activation of the fan timer 44, the fan 14 stops rotating. Stated differently, rotation of the fan 14 is not stopped even if the trigger switch 6 is turned off but continued for the prescribed time after the head switch 16 is turned off. Therefore, the air in the combustion chamber 26 can be scavenged through the first and second flow passages S1 and S2 by drawing fresh air from through the intake port and discharging the exhausts residual gas out through the discharge port.

After repetitive nail driving operations, the stopper driver circuit 60 does not operate as far as no signal is available from the temperature switch control circuit 45. Thus, the stopper 61 is held in the upper position. Scavenging and cooling operations are performed with the same amount of fresh air each time the nail driving operation is carried out.

Continuous nail driving operations result in temperature rise in the combustion chamber frame 11 and the cylinder 20. When the temperature of the combustion chamber frame 11 becomes higher than the critical value, the temperature switch control circuit 45 outputs a signal to the stopper driver circuit 60 through the first AND circuit 46. As far as the fan 14 is rotating, the stopper 61 is controlled to be in a DOWN position. At this time, the channel height of the first flow passage S1 is set to Lh and the subsequent nail driving operation is performed while maintaining this channel height of the first flow passage S1. Since Lh is greater than Lc, the cross-sectional area of the first flow passage S1 increases in the state in FIG. 2 as compared with the state in FIG. 1. Accordingly, with the state shown in FIG. 2, an amount of fresh air introduced into the combustion chamber 26 is increased, thereby enhancing the cooling effect on the combustion chamber frame 11 and the cylinder 20. It should be noted that the amount of air increases in proportion to a cross-sectional area of the channel through which the air flows. Accordingly, the nail driving operations need not be interrupted for the purpose of cooling the tool 1 but can be continued.

When the sensed temperature falls below the critical value, no signal is output from the temperature switch control circuit 45, and the stopper 61 returns to the initial UP position and the channel height of the first flow passage S1 returns to Lc.

As described, according to the embodiment of the invention, the channel height of the first flow passage S1 is changed from Lc to Lh (Lc<<Lh) or vice versa depending on the temperature of the combustion chamber frame 11 and/or the cylinder 20. While it may be possible to fixedly set the channel height of the first flow passage S1 to Lh without using the stopper 61, this strategy is not realistic because the stroke of the push lever 10 increases by (Lh—Lc). The increased stroke of the push lever 10 opposes to the easy-to-use policy and urges the user to push the tool 1 a longer distance against the workpiece W. The present invention has adopted a strategy not to impose superfluous work upon the user by setting the stroke of the push lever 10 to a proper minimum length which can be changed depending on the temperature of the combustion chamber frame 11 or the cylinder 20.

While the invention has been described in detail with reference to a specific embodiment thereof, it would be apparent to those skilled in the art that many modifications and variations may be made therein.

For example, while the embodiment describes the fastener driving tool in which the trigger switch 6 is turned on and off each time the nail driving operation is performed, the present invention is applicable to a fastener driving tool of a continuous type in which the fasteners are driven continuously by holding the trigger switch 6 in on state and repeatedly carrying out the push-and-release operations with respect to the workpiece. The block circuit diagram shown in FIG. 3 is also available for the continuous type driving tool. When at least one of the head switch 16 and the trigger switch 6 is turned on, the fan 14 starts rotating and the temperature of the combustion chamber frame 11 or the cylinder 20 can be sensed. In accordance with the sensed temperature, the channel height of the first flow passage S1 is determined by means of the stopper 61. Due to the operation of the fan timer 44, this channel height is maintained even if both the head switch 16 and the trigger switch 6 are turned off.

Further, the embodiment describes a temperature control based on a temperature detected at a particular point, the temperature control may be implemented based on a plurality of detections of temperature at various points, such as points on not only the combustion chamber frame but also the housing or other portions.

While the embodiment describes the electromagnetic solenoid as a means for driving the stopper 61, the stopper may be formed from shape memory alloy to function as the temperature sensor as well.

What is claimed is:

1. A combustion-type power tool comprising:

a housing having first and second end portions;

a head provided at the first end portion of the housing;

a handle extending from the housing;

a cylinder fixedly disposed within the housing;

a piston movably supported in the cylinder;

a combustion chamber frame disposed within the housing to be movable along the cylinder, a combustion chamber being formed by the head, the cylinder, the piston, and the combustion chamber frame when the combustion chamber frame is in abutment with the head, the combustion chamber accommodating a gaseous mixture of existing air in the combustion chamber and fuel injected therein;

a push lever mounted on the second end portion of the housing and coupled with the combustion chamber frame, the push lever being movable into the housing, causing the combustion chamber frame to move together with the push lever, when the push lever is pushed against a workpiece;

a spark plug that is disposed in the combustion chamber and generates a spark to combust the gaseous mixture in the combustion chamber, the piston being driven by combustion in the combustion chamber;

a trigger switch provided to the handle, the trigger switch producing the spark in the spark plug when operated;

a driving blade extending from the piston for driving a fastener;

a temperature sensor that senses a temperature of at least one selected portion within the housing or on the handle; and a stopper operable to adjust a position of the push lever to be shifted from a first position to a second position when the temperature sensed by the temperature sensor is higher than a critical value.

2. The combustion-type power tool according to claim 1, wherein the push lever is positioned farther from the head when the push lever is in the second position than when the push lever is in the first position.

3. The combustion-type power tool according to claim 1, wherein the stopper is selectively movable between the first and second positions.

4. The combustion-type power tool according to claim 1, wherein the temperature sensor is disposed on the combustion chamber frame.

5. The combustion-type power tool according to claim 1, wherein the stopper is operated by an electromagnetic solenoid.

6. The combustion-type power tool according to claim 1, wherein the temperature sensor comprises a thermistor.

7. The combustion-type power tool according to claim 1, wherein the temperature sensor comprises a thermocouple.

8. The combustion-type power tool according to claim 1, wherein the temperature sensor comprises a bimetal.

* * * * *